US007672614B2

(12) United States Patent
Kang et al.

(10) Patent No.: US 7,672,614 B2
(45) Date of Patent: Mar. 2, 2010

(54) DRIVING APPARATUS, PROCESS CARTRIDGE AND IMAGE FORMING DEVICE HAVING THE SAME

(75) Inventors: Il-kwon Kang, Suwon-si (KR); Byeong-hwa Ahn, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 147 days.

(21) Appl. No.: 11/372,390

(22) Filed: Mar. 10, 2006

(65) Prior Publication Data

US 2007/0077091 A1 Apr. 5, 2007

(30) Foreign Application Priority Data

Oct. 4, 2005 (KR) ..... 10-2005-0093163

(51) Int. Cl.
*G03G 15/00* (2006.01)

(52) U.S. Cl. ..... 399/167; 399/111

(58) Field of Classification Search ..... 399/167, 399/111, 116, 117; 74/606 R, 414, 413, 74/412 R, 421 A
See application file for complete search history.

(56) References Cited

U.S. PATENT DOCUMENTS 5,920,753 A * 7/1999 Sasaki et al. ..... 399/111
6,463,234 B2 * 10/2002 Arimitsu et al. ..... 399/113

FOREIGN PATENT DOCUMENTS

| | | |
|---|---|---|
| CN | 1304065 | 7/2001 |
| JP | 11-223993 | 8/1999 |
| JP | 2000-347487 | 12/2000 |
| JP | 2002-258674 | 9/2002 |
| JP | 2003-167433 | 6/2003 |
| JP | 2003-295614 | 10/2003 |

* cited by examiner

*Primary Examiner*—David M Gray
*Assistant Examiner*—Ryan D Walsh
(74) *Attorney, Agent, or Firm*—Roylance, Abrams, Berdo & Goodman, L.L.P.

(57) ABSTRACT

A driving apparatus includes a driving gear connected to a driving motor, a driven gear engaged with the driving gear, and a driving force coupling part coupling the driving gear and the driven gear to not move with respect to each other. The driving force coupling part includes an axle distance maintaining member to maintain a substantially constant distance between axes of the driving gear and the driven gear. The driving apparatus couples the driving gear and the driven gear to not move with respect to each other when a driving force is transmitted from the driving gear to the driven gear, thereby maintaining a substantially uniform distance between axes of the driving gear and the driven gear. Accordingly, a driven gear shaft is substantially prevented from changing position and deformation of a process cartridge is substantially prevented due to a driving torque of the driving gear and a load torque of the driven gear. Thus, a change in a gap between a developing roller and a photoconductive medium is minimized.

19 Claims, 9 Drawing Sheets

DRIVING APPARATUS, PROCESS CARTRIDGE AND IMAGE FORMING DEVICE HAVING THE SAME

CROSS REFERENCE TO RELATED APPLICATIONS

This application claims the benefit under 35 U.S.C. §119 (a) from Korean Patent Application No. 2005-93163, filed on Oct. 4, 2005, in the Korean Intellectual Property Office, the entire contents of which are hereby incorporated by reference.

BACKGROUND OF THE INVENTION

1. Field of the Invention

The present invention relates to an electrophotographic image forming device, such as a laser printer, digital photocopier and facsimile machine. More particularly, the present invention relates to a driving apparatus to transmit a driving force from a driving gear to a driven gear, a process cartridge and an image forming device which have the driving apparatus.

2. Description of the Related Art

Generally, electrophotographic image forming devices, such as laser printers, digital photocopiers, and facsimile machines, include one or a plurality of process cartridges. The process cartridge integrates a photoconductive medium unit and a developing unit as a single modular unit. The photoconductive unit has a photoconductive medium that is scanned with laser beams to form an electrostatic latent image thereon, and the developing unit has a developing roller to develop an electrostatic latent image into a developer image. The process cartridge may include only the developing unit as a single modular unit.

The process cartridge is mountable and dismountable for conveniently repairing or replacing the process cartridge.

Also, when the process cartridge includes the photoconductive medium unit and the developing unit as a single modular unit, the developing unit is driven by a driving force transmitted from a driving motor of a body to the photoconductive medium unit, along with the photoconductive medium unit, or it is driven by a driving force transmitted from the driving motor of the body, independently from the photoconductive medium unit.

When the developing unit is driven by a driving force transmitted to the photoconductive medium unit along with the photoconductive medium unit, the developing unit is still driven along with the photoconductive medium unit even when the photoconductive medium idly rotates, that is, when the developing unit does not need to develop an electrostatic latent image formed on the photoconductive medium. The unnecessary driving operation of the developing unit as described above causes friction between a developing roller and a supplying roller for supplying the developing roller with a developer and between the developing roller and a developer regulation blade for regulating the thickness of a developer layer, thereby increasing a developer stress. The increased developer stress deteriorates the uniformity of development and thus degrades quality of image.

Also, because the developing roller and the photoconductive medium are connected to each other through a plurality of gears, the number of teeth of each gear and distances between axes of gears must be taken into account to adjust a velocity ratio between the photoconductive medium and the developing roller to control the developing capability. Therefore, it is difficult to adjust the velocity ratio.

For the above-described reason, a process cartridge that separately drives the developing unit and the photoconductive medium unit is coming into increasing use.

FIG. 1 is an exploded, perspective view illustrating a general process cartridge 1 that separately drives a developing unit and a photoconductive medium unit.

The process cartridge 1 includes a photoconductive medium unit 2, a developing unit 8, and a housing 10.

The photoconductive medium unit 10 includes a drum-type photoconductive medium 4 that is rotatably disposed in a photoconductive medium casing 11 of the housing 10.

As shown in FIG. 3, a first driven gear 6 is disposed on a first end portion 5*a* of a photoconductive medium shaft 5 that outwardly protrudes from a first lateral frame 11*a* of the photoconductive medium casing 11 and is covered by a first lateral cover 33. The first driven gear 6 is engaged with a first driving gear 16 of a gear train connected to a driving motor (not shown) disposed in a body when the process cartridge 1 is pushed in the direction indicated by arrow 'A' and mounted in the body.

Accordingly, when the driving motor of the body is driven after the process cartridge 1 is mounted in the body as shown in FIG. 2, the first driven gear 6 is rotated by the first driving gear 16 in one direction, for example, in a clockwise direction (see FIG. 3). When the first driven gear 6 is rotated in a clockwise direction, the photoconductive medium 4 coaxially disposed with the first driven gear 6 is rotated in a clockwise direction.

As shown in FIG. 3, a charging roller (not shown) for charging the surface of the photoconductive medium 4, a cleaning member (not shown), such as a cleaning roller or cleaning blade, for cleaning the photoconductive medium 4, and a developing roller 7 of the developing unit 8 are arranged along the photoconductive medium 4.

The developing unit 8 includes the developing roller 7 disposed in a developing casing 13 of the housing 10 and contacting the photoconductive medium 4 with a constant gap therebetween, a supplying roller 14 for supplying the developing roller 7 with a developer, and a developer regulation blade (not shown) for regulating the thickness of a developer layer in contact with the developing roller 7.

A developing roller gear 7*b* is disposed on a developing roller shaft 7*a* protruding from a first lateral frame 13*a* of the developing casing 13 and covered by a second lateral cover 28. The developing roller gear 7*b* is connected to a second driven gear 19 via a driving force transmission gear 15 and a deceleration gear 17 that are rotatably disposed between the first lateral frame 13*a* and the second lateral cover 28. A supplying roller gear 14*b*, which is coaxially disposed with the supplying roller 14, is connected to a lower portion of the driving force transmission gear 15 connected to the developing roller gear 7*b*.

As shown in FIG. 3, the second driven gear 19 is engaged with a second driving gear 18 of a gear train connected to the driving motor disposed in the body when the process cartridge 1 is mounted in the body. Accordingly, when the driving motor of the body is driven after the process cartridge 1 is mounted in the body, the second driven gear 19 is rotated in relation to the second driving gear 18 in one direction, for example, in a counterclockwise direction. The clockwise rotational force of the second driven gear 19 is transmitted to the developing roller gear 7*b* and the supplying roller gear 14*b* via the deceleration gear 17 and the driving force transmission gear 15. As a result, the developing roller 7 and the supply roller 14 are respectively rotated in a counter clockwise direction.

The housing 10 includes the photoconductive medium casing 11 and the developing casing 13.

The photoconductive medium casing 11 includes the first lateral frame 11*a* and a second lateral frame 11*b*, which support shafts of the components of the photoconductive medium unit 2, for example, shafts of the photoconductive medium 4 and the charging roller, and the first lateral cover 33 for sealing the first driven gear 6 disposed on an outer surface of the first lateral frame 11*a*.

The developing casing 13 includes the first lateral frame 13*a* and a second lateral frame 13*b*, which support shafts of the components of the developing unit 8, for example, shafts of the developing roller 7, the supplying roller 14, the driving force transmission gear 15, the deceleration gear 17, and the second driven gear 19, and the second lateral cover 28 for sealing the developing roller gear 7*b*, the supplying roller gear 14*b*, the driving force transmission gear 15, the deceleration gear 17, and the second driven gear 19, which are disposed on an outer surface of the first lateral frame 13*a*.

The photoconductive casing 11 and the developing casing 13 are connected to each other via a slide groove 12*a* formed in a lower portion 12 (see FIG. 3) of the first lateral frame 11*a* of the photoconductive medium casing 11 to receive the developing roller shaft 7*a*, and a fixing hole (not shown) of a fixing part (not shown) formed at a rear portion of the second lateral frame 13*b* of the developing casing 13 to receive and rotatably support a second end portion (not shown) of the photoconductive medium shaft 5.

First and second protruding seating members 20 and 21 and first and second locking springs 23 and 24 are disposed at portions of the body that correspond to the first and the second end portions 5*a* of the photoconductive medium shaft 5 that protrude outwardly from the rear portions of the first and the second lateral frames 11*a* and 11*b* of the photoconductive medium casing 11.

First and second mounting guide recesses 29 (only the first mounting guide recess 29 is illustrated in the drawings) are formed in front portions of the second lateral cover 28 of the developing casing 13 (the right in the drawings) to receive and guide first and second mounting protrusions 26 and 27 formed on the body, when the process cartridge 1 is mounted in the body.

Accordingly, when the process cartridge 1 is mounted in the body by being pushed in the direction indicated by arrow 'A' as shown in FIG. 1, the first and second mounting guide recesses 29 of the process cartridge 1 receive and guide the first and second mounting protrusions 26 and 27. Also, the first and second end portions 5*a* of the photoconductive medium shaft 5 upwardly push supporting ends of the first and second locking springs 23 and 24, which are seated in the first and second protruding seating members 20 and 21, and then are elastically locked into the first and second protruding seating members 20 and 21 by the supporting ends of the first and the second locking springs 23 and 24.

On the other hand, when the process cartridge 1 is pulled out in the direction indicated by arrow 'B' and is dismounted from the body, the first and second mounting guide recesses 29 guide the first and the second mounting protrusions 26 and 27 to remove them, and the first and the second end portions 5*a* of the photoconductive medium shaft 5 upwardly push the supporting ends of the first and the second locking springs 23 and 24 against the elastic force of the first and second locking springs 23 and 24, thereby escaping from the first and second protruding seating members 20 and 21.

However, according to the conventional process cartridge 1 as constructed above, because the first driven gear 6 transmits a driving force to only the photoconductive medium 4 and the second driven gear 19 transmits a driving force to both the developing roller 7 and the supplying roller 14 through the plurality of gears 17, 15, 7*b*, 14*b*, a load torque of the second driven gear 19 in response to a rotational force of the second driving gear 18 connected to the gear train connected to the driving motor of the body, in other words, a load torque of the second driven gear 19 in response to a driving torque of the second driving gear 18 is greater than a load torque of the first driven gear 6 in response to a driving torque of the first driving gear 16.

Also, the photoconductive medium 4 is supported by the first and second lateral frames 11*a* and 11*b* of the photoconductive medium casing 11, whereas the second driven gear 19 is supported by only the first lateral frame 13*a* of the developing casing 13.

Accordingly, when a driving force of the driving motor of the body is transmitted from the second driving gear 18 to the second driven gear 19, the second driven gear 19 is subjected to a force 'F1' that is generated by a load torque in response to the driving torque of the second driving gear 18. Although the process cartridge 1 at both sides is supported at the first and second protruding seating members 20 and 21 and the first and the second mounting protrusions 26 and 27 by the first and the second end portions 5*a* of the photoconductive medium shaft 5 and the first and second mounting guide recesses 29, the first lateral frame 13*a* of the developing casing 13 is pushed by the force 'F1' generated by the load torque because the first lateral frame 13*a* of the developing casing 13, to which the second driven gear shaft 19*a* is fixed, and the first lateral frame 11*a* of the photoconductive medium casing 11 are movably fixed each other through the slide groove 12*a* and the developing roller shaft 7*a*. As a result, the second driven gear 19 does not maintain a constant position and changes a distance between its axis and the axis of the second driving gear 18, depending on the change in the load torque. Thus, the second driven gear shaft 19*a* changes position. Simultaneously, the process cartridge 1 suffers from a warp deformation, such that the photoconductive medium casing 11 and the developing casing 13 become warped downwardly with respect to the developing roller shaft 7*a*.

Also, because the process cartridge 1 is in the shape of both arm beams, such that both ends thereof are supported at the first and the second protruding seating members 20 and 21 and the first and the second mounting protrusions 26 and 27 by the first and second end portions 5*a* of the photoconductive medium shaft 5 and the first and second mounting guide recesses 29, the second driven gear 19, which is located in the middle of the process cartridge 1, generates a vibration due to repulsive forces F2 and F3 of the first and the second protruding seating members 20 and 21 and the first and the second mounting protrusions 26 and 27 in response to the driving torques of the first and the second driving gears 16 and 18. Accordingly, the second driven gear shaft 19*a* greatly changes position due to the load torque of the second driven gear 19.

When the second driven gear shaft 19*a* changes position due to the vibration and thus the process cartridge 1 is deformed, the developing roller 7, which is fixed to the first and second lateral frames 13*a* and 13*b* of the developing casing 13 to maintain a constant gap with respect to the photoconductive medium 4 using a gap ring (not shown), changes a gap size with respect to the photoconductive medium 4. As a result, there occurs a defect, such as jittering, in an image obtained by the process cartridge 1 due to the change in the gap between the developing roller 7 and the photoconductive medium 4.

Accordingly, a need exists for an improved driving apparatus for an image forming device.

SUMMARY OF THE INVENTION

Accordingly, an aspect of the present invention is to provide a driving apparatus for coupling a driving gear and a driven gear without moving with respect to each other when a driving force is transmitted from the driving gear to the driven gear, thereby substantially preventing a driven gear shaft from changing position and substantially preventing deformation of a process cartridge due to a driving torque of the driving gear and a load torque of the driven gear, thereby reducing a change in a gap between a developing roller and a photoconductive medium, a process cartridge and an image forming device having the same.

Another aspect of the present invention is to provide a driving apparatus for maintaining a substantially constant distance between axes of a driving gear and a driven gear when a driving force is transmitted from the driving gear to the driven gear, thereby substantially preventing a driven gear shaft from changing position and substantially preventing deformation of a process cartridge due to a driving torque of the driving gear and a load torque of the driven gear, thereby minimizing a change in a gap between a developing roller and a photoconductive medium, a process cartridge and an image forming device having the same.

According to one exemplary embodiment of the present invention, a driving apparatus of an image forming device includes a driving gear connected to a driving motor, a driven gear engaged with the driving gear, and a driving force coupling part coupling the driving gear and the driven gear that do not move with respect to each other.

According to an exemplary implementation of the present invention, the driving force coupling part includes an axle distance maintaining member to maintain a distance between axes of the driving gear and the driven gear.

According to an exemplary implementation of the present invention, the axle distance maintaining member includes a shaft supporting bracket, which includes one end fixed to a driven gear shaft and the other end having a shaft supporting part receiving and supporting a driving gear shaft. Preferably, the shaft supporting part includes a shaft supporting recess, which includes an entrance being open to receive and remove the driving gear shaft therethrough, and a seating portion, which includes a plurality of shaft supporting surfaces formed in direction different to a direction in which a driving torque of the driving gear and a load torque of the driven gear generated in response to the driving torque are exerted and receives the driving gear shaft to restrict the driving gear.

According to an exemplary implementation of the present invention, the driving gear is disposed in a body of the image forming device and connected to a driving motor, and the driven gear is disposed in a process cartridge dismountably disposed in the body and is engaged with the driving gear to transmit a driving force to a developing roller when the process cartridge is mounted in the body.

According to another exemplary embodiment of the present invention, a process cartridge of an image forming device includes at least one of a photoconductive unit having a photoconductive medium where an electrostatic latent image is formed and a developing unit having a developing roller to develop an electrostatic latent image of the photoconductive unit. A driving apparatus unit includes at least one of a first driven gear formed on a photoconductive medium shaft and a second driven gear transmitting a driving force to the developing roller. A driving coupling part couples at least one of the first and second driven gears and at least one driving gear disposed on a body of the image forming device, but not to move with respect to each other. A housing integrates at least one of the photoconductive medium unit and the developing unit, and the driving apparatus unit as a single modular unit.

According to an exemplary implementation of the present invention, the driving force coupling part includes an axle distance maintaining member to substantially uniformly maintain a distance between axes of at least one of the first and second driven gears and the at least one driving gear.

According to an exemplary implementation of the present invention, the axle distance maintaining member includes at least one shaft supporting bracket, which has one end fixed to at least one of a first and second driven gear shafts and the other end having a shaft supporting part receiving and supporting a driving gear shaft when the process cartridge is mounted in the body. According to an exemplary implementation of the present invention, the shaft supporting part includes a shaft supporting recess. The shaft supporting recess includes an entrance being open in a direction of receiving and removing the driving gear shaft to receive and remove the driving gear shaft when the process cartridge is mounted in and dismounted from the body. A seating portion includes a plurality of shaft supporting surfaces that are formed in direction different to a direction in which a driving torque of the driving gear and a load torque of at least one of the first and second driven gears generated in response to the driving torque are exerted. The seating potion receives the driving gear shaft to restrict the driving gear shaft.

According to still another exemplary embodiment of the present invention, an image forming device includes a body having at least one driving motor and at least one driving gear connected to the driving motor, and at least one process cartridge. The process cartridge includes at least one of a photoconductive medium unit having a photoconductive medium where an electrostatic latent image is formed and a developing unit having a developing roller to develop an electrostatic latent image of the photoconductive medium. A driving apparatus unit includes at least one of a first driven gear formed on a photoconductive medium shaft and a second driven gear transmitting a driving force to the developing roller. A driving force coupling part couples at least one of the first and second driven gears and the at least one driving gear of the body, but not to move with respect to each other. A housing integrates at least one of the photoconductive medium unit and the developing unit, and the driving apparatus unit as a single modular unit.

According to an exemplary implementation of the present invention, the driving force coupling part includes an axle distance maintaining member to maintain a substantially constant distance between axes of at least one the first and second driven gears and the at least one driving gear.

According to an exemplary implementation of the present invention, the axle distance maintaining member includes at least one shaft supporting bracket that includes one end fixed to at least one of a first and second driven gear shafts and the other end having a shaft supporting part receiving and supporting a driving gear shaft when the process cartridge is mounted in the body.

According to an exemplary implementation of the present invention, the shaft supporting part includes a shaft supporting recess that includes an entrance being open in a direction of receiving and removing the driving gear shaft to receive and remove the driving gear shaft when the process cartridge is mounted in and dismounted from the body, and a seating portion having a plurality of shaft supporting surfaces formed in a direction different to a direction in which a driving torque of the driving gear and a load torque of at least one of the first and the second driven gears generated in response to the driving torque are exerted. The seating portion receives the driving gear shaft to restrict the driving gear shaft.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

These and other aspects of the present invention will become apparent and more readily appreciated from the following description of the exemplary embodiments, taken in conjunction with the accompanying drawings of which.

Throughout the drawings, the same drawing reference numerals will be understood to refer to the same elements, features, and structures.

DETAILED DESCRIPTION OF EXEMPLARY EMBODIMENTS

Hereinafter, a driving apparatus, a process cartridge and an image forming device having the same according to an exemplary embodiment of the present invention will now be described in greater detail with reference to the accompanying drawings.

Figure 4A:
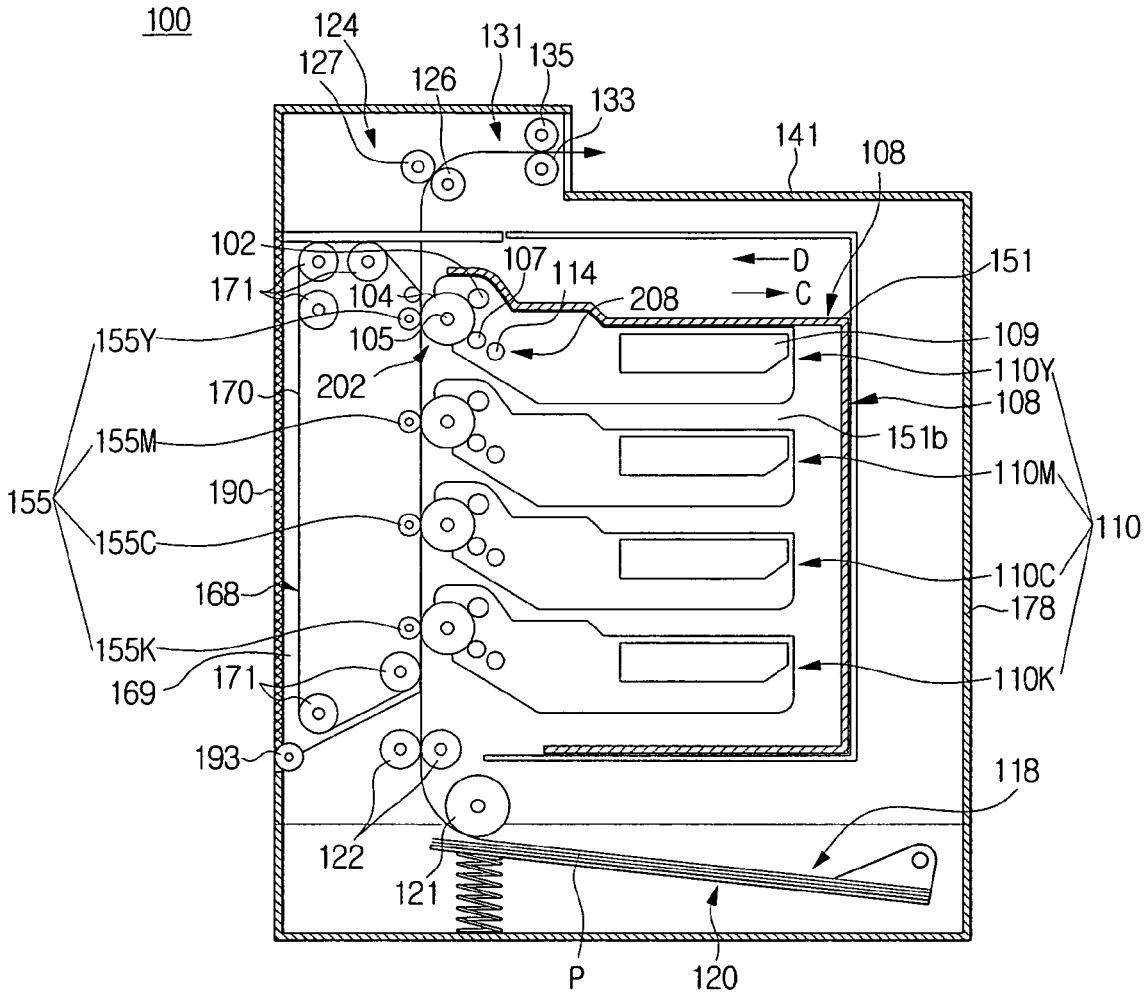
FIGS. 4A and 4B are elevational views in partial cross section illustrating opening and closing of a body cover of an image forming device that includes a first, second, third, and fourth process cartridges, each employing a driving unit having a driving force coupling part.
Figure 4B:
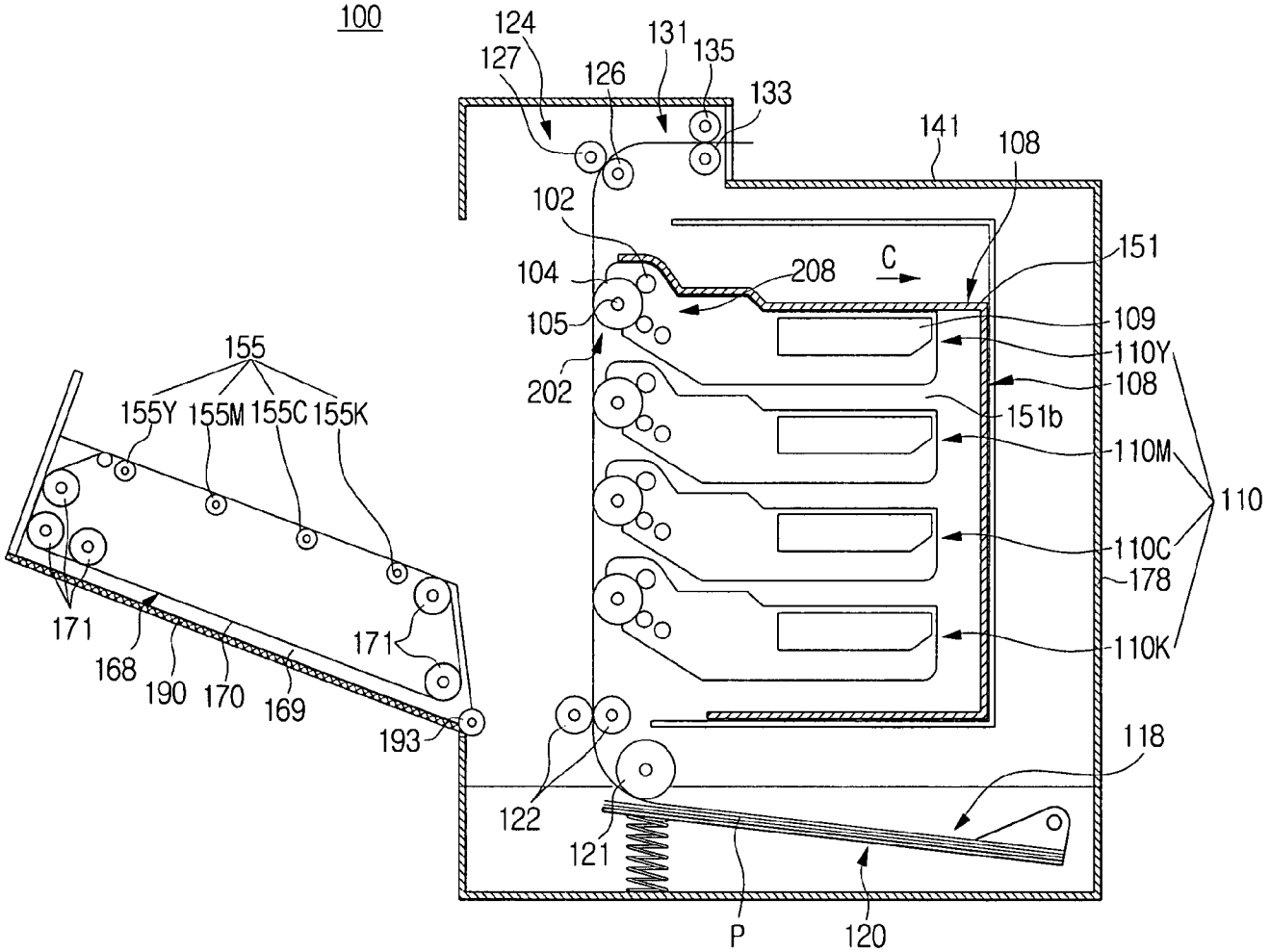

FIGS. 4A and 4B are views schematically illustrating an image forming device having process cartridges, each of which employs a driving force coupling part according to an exemplary embodiment of the present invention.

In an exemplary embodiment, the image forming device is a color image forming apparatus 100 that prints and outputs data input from an external device, such as a personal computer (PC).

The color image forming device 100 according to an exemplary embodiment of the present invention includes a paper feeding unit 118, a cartridge frame 108, a cartridge unit 110, a cartridge fixing unit 219 (see FIGS. 5 and 6), a driving unit 215 (see FIGS. 5 and 6), a transfer unit 168, a fusing unit 124, and a paper discharge unit 131.

The paper feeding unit 118 supplies paper P and includes a paper feeding cassette 120, a pickup roller 121, and a conveyance and backup roller 122. Because the paper feeding cassette 120, the pickup roller 121, and the conveyance and backup roller 122 are substantially identical to those of conventional image forming devices, detailed descriptions thereof are omitted for the sake of conciseness and brevity.

The cartridge frame 108 holds the cartridge unit 110 and is disposed above the paper feeding unit 118.

The cartridge frame 108 includes a rectangular chest body 151 in which the cartridge unit 110 is disposed.

The cartridge unit 110 includes first, second, third, and fourth process cartridges 110Y, 110M, 110C, and 110K, which are vertically arranged at certain intervals.

The first to the fourth process cartridges 110Y to 110K form color toner images, such as yellow, magenta, cyan, and black toner images.

Because the first to the fourth process cartridges 110Y to 110K have substantially the same construction, only the first process cartridge 110Y is described for the sake of conciseness and brevity.

Figure 5:
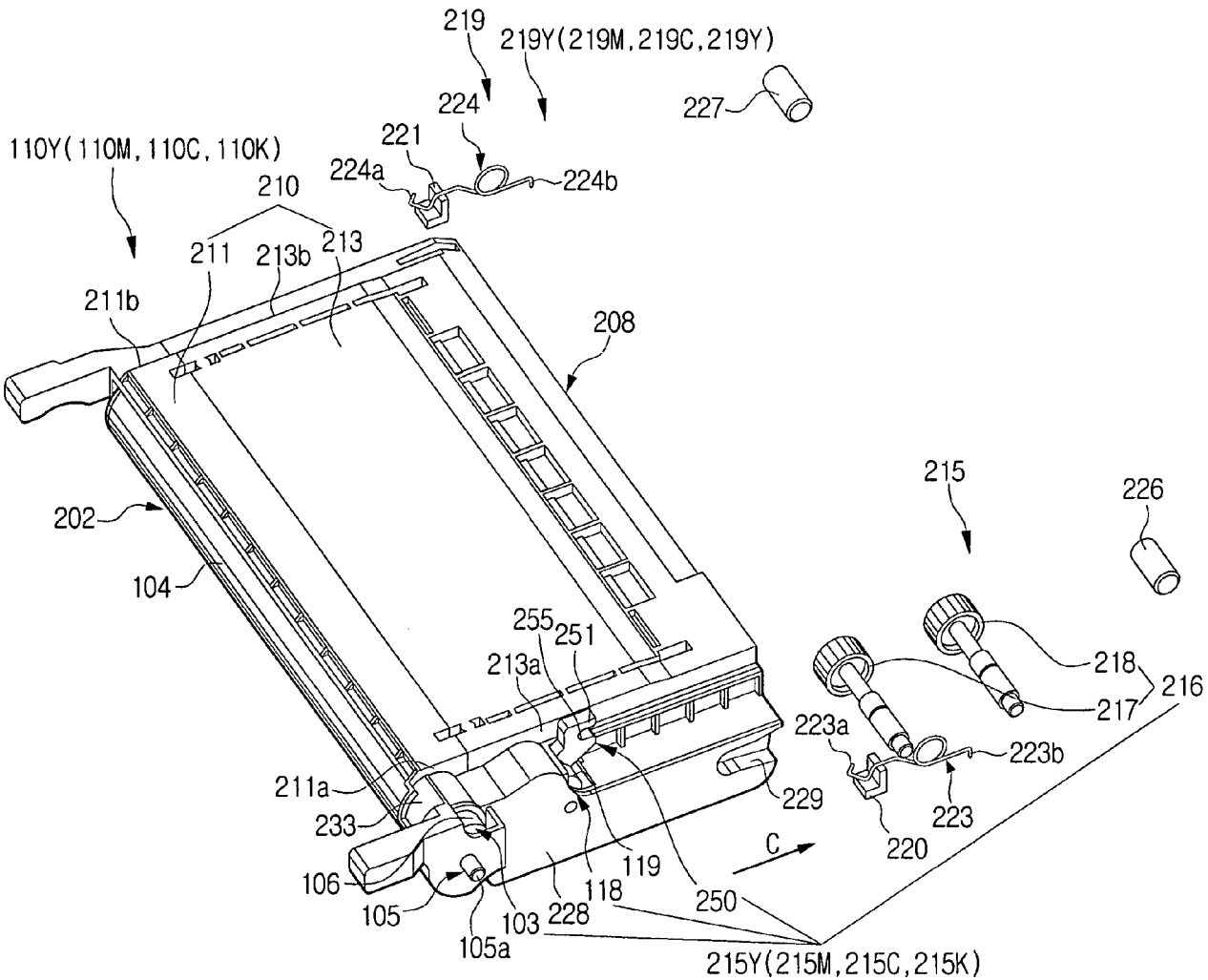
FIGS. 5 and 6 are perspective views illustrating mounting and dismounting the first process cartridge of the image forming device of FIG. 4A.

As shown in FIG. 5, the first process cartridge 110Y includes a photoconductive medium unit 202, a developing unit 208, a laser scanning unit (LSU) 109 (see FIGS. 4A and 4B), and a housing 210 integrating the above-mentioned components as a single modular unit.

The photoconductive medium unit 202 includes a photoconductive medium 104 that is rotatably supported in a photoconductive medium casing 211. The photoconductive medium 104 is, for example, an organic photoconductive (OPC) drum.

As shown in FIGS. 4A and 4B, a charging roller 102 for charging the surface of the photoconductive medium 104 and a photoconductive medium cleaner (not shown) for removing waste developer remaining in the surface of the photoconductive medium 104 are disposed at predetermined positions of the outer circumference of the photoconductive medium 104 in a rotational direction. Because the charging roller 102 and the photoconductive medium cleaner (not shown) are identical to those of a conventional image forming device, detailed descriptions thereof are omitted.

Figure 8A:
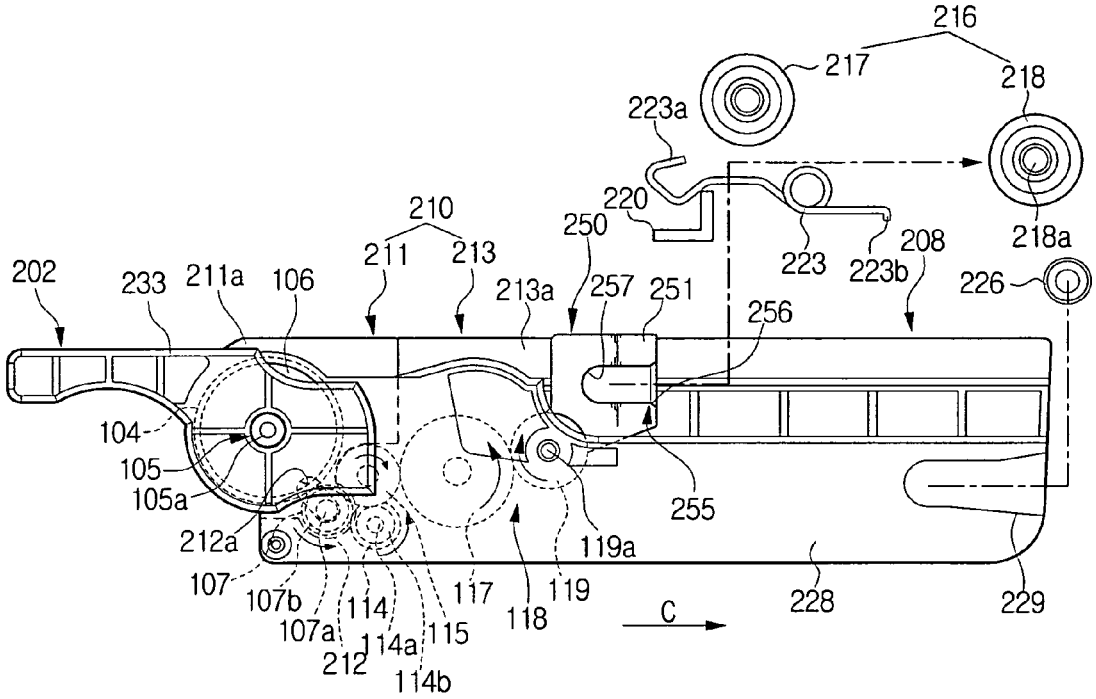
FIGS. 8A and 8B are side elevational views in partial cross section illustrating the first process cartridge of the image forming device as shown in FIGS. 5 and 6.
Figure 8B:
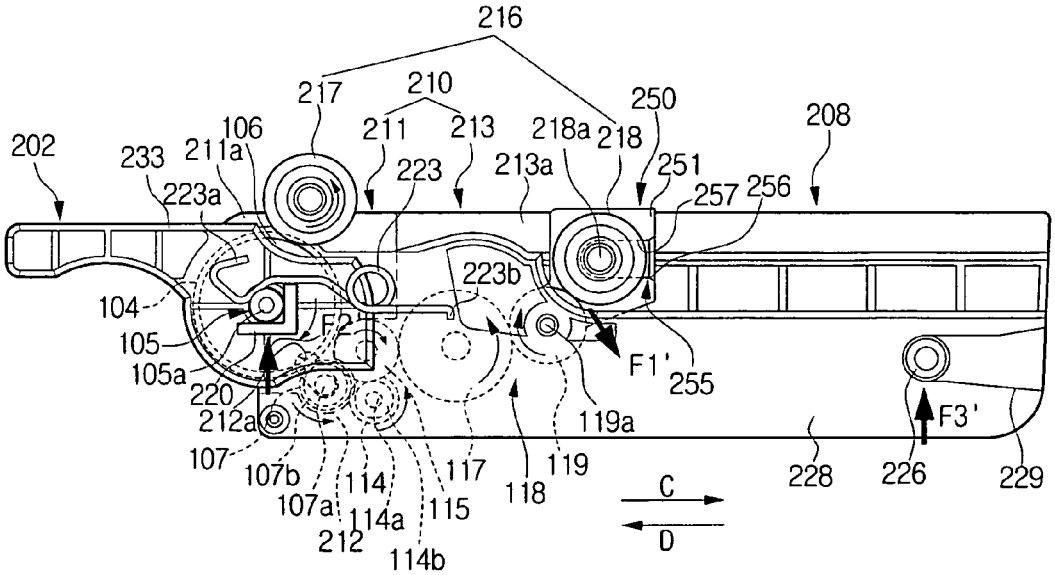

As shown in FIGS. 8A and 8B, the developing unit 208 includes a developing roller 107 that is disposed in a developing casing 213 and faces the photoconductive medium 104 with a constant gap therebetween. A supplying roller 114 supplies the developing roller 107 with a developer. A developer regulation blade (not shown) regulates the thickness of a developer layer formed on the developing roller 107. Because the developing roller 107, the supplying roller 114, and the developer regulation blade are substantially identical to those of a conventional image forming device, detailed description thereof is omitted for the sake of conciseness and brevity.

The LSU 109 is arranged to scan the photoconductive medium 104 with laser beams in front of the developing casing 210 (the right in the drawings). The LSU 109 irradiates laser beams toward the surface of the photoconductive medium 104 charged by the charging roller 102 using a laser diode, according to an image signal input from an external device, such as a PC, and thereby forms an electrostatic latent image.

Although the LSU 109 is integrated in the developing casing 213 of the developing unit 208 as a modular unit in this exemplary embodiment, it may be disposed in the chest body 151 of the cartridge frame 108 independently from the first process cartridge 110Y.

As shown in FIGS. 5 to 8B, the housing 210 includes the photoconductive medium casing 211 and the developing casing 213.

The photoconductive medium casing 211 includes first and second lateral frames 211*a* and 211*b* for supporting shafts of components of the photoconductive medium unit 202, such as the shafts of photoconductive medium 104 and the charging roller 102, and a first lateral cover 233 for sealing a first driven gear 106 disposed on an outer surface of the first lateral frame 211*a*.

The developing casing 213 includes first and second lateral surfaces 213*a* and 213*b* for supporting shafts of components of the developing unit 208, such as the shafts of the developing roller 107, the supplying roller 114, a driving force transmission gear 115, a deceleration gear 117, and a second driven gear 119; and a second lateral cover 228 for sealing a developing roller gear 107*b*, a supplying roller gear 114*b*, the driving force transmission gear 115, the deceleration gear 117, and the second driven gear 119, which are disposed on an outer surface of the first lateral frame 213*a*.

Figure 1:
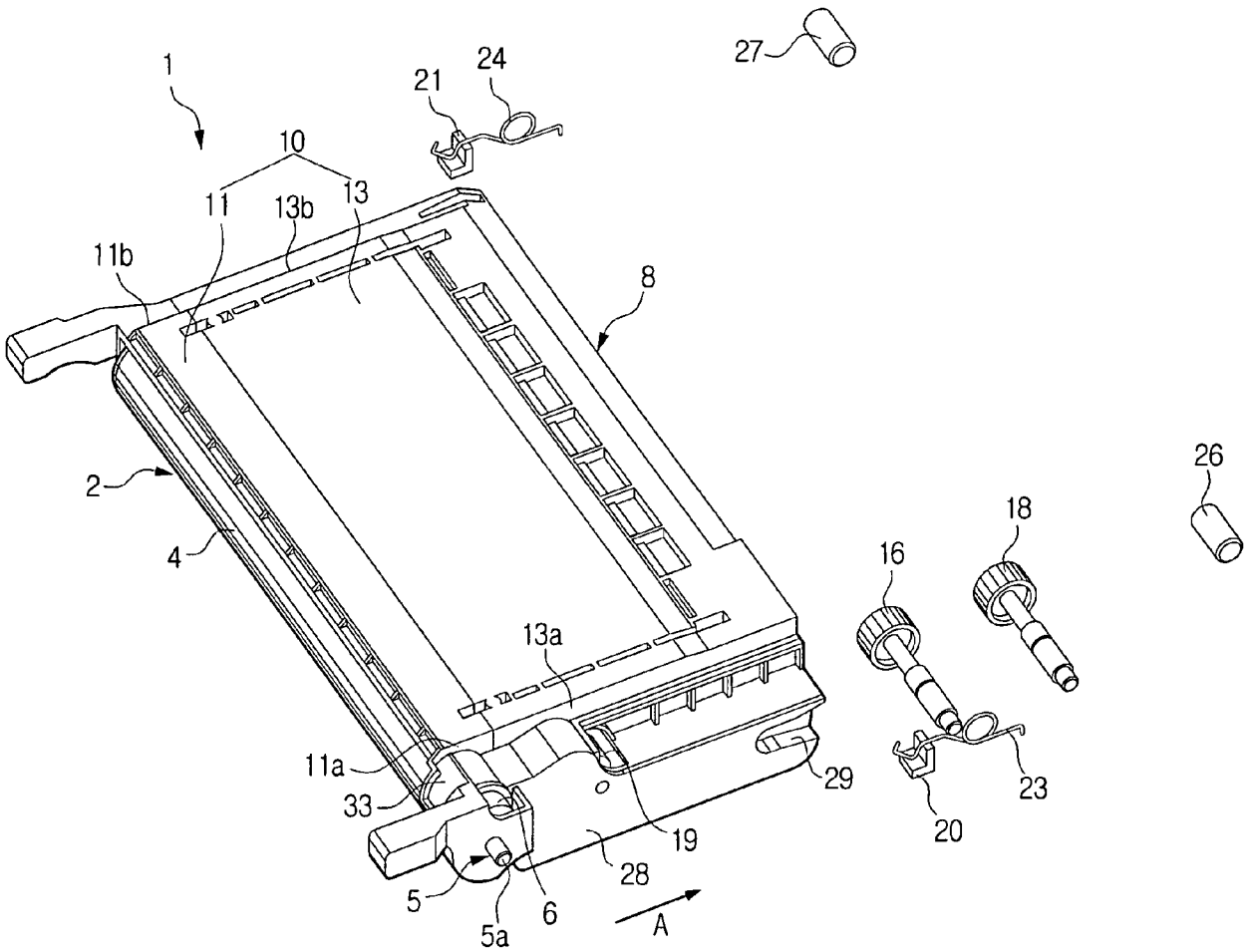
FIG. 1 (PRIOR ART)
FIGS. 1 and 2 are perspective views illustrating mounting and dismounting a process cartridge of a general image forming device.
Figure 2:
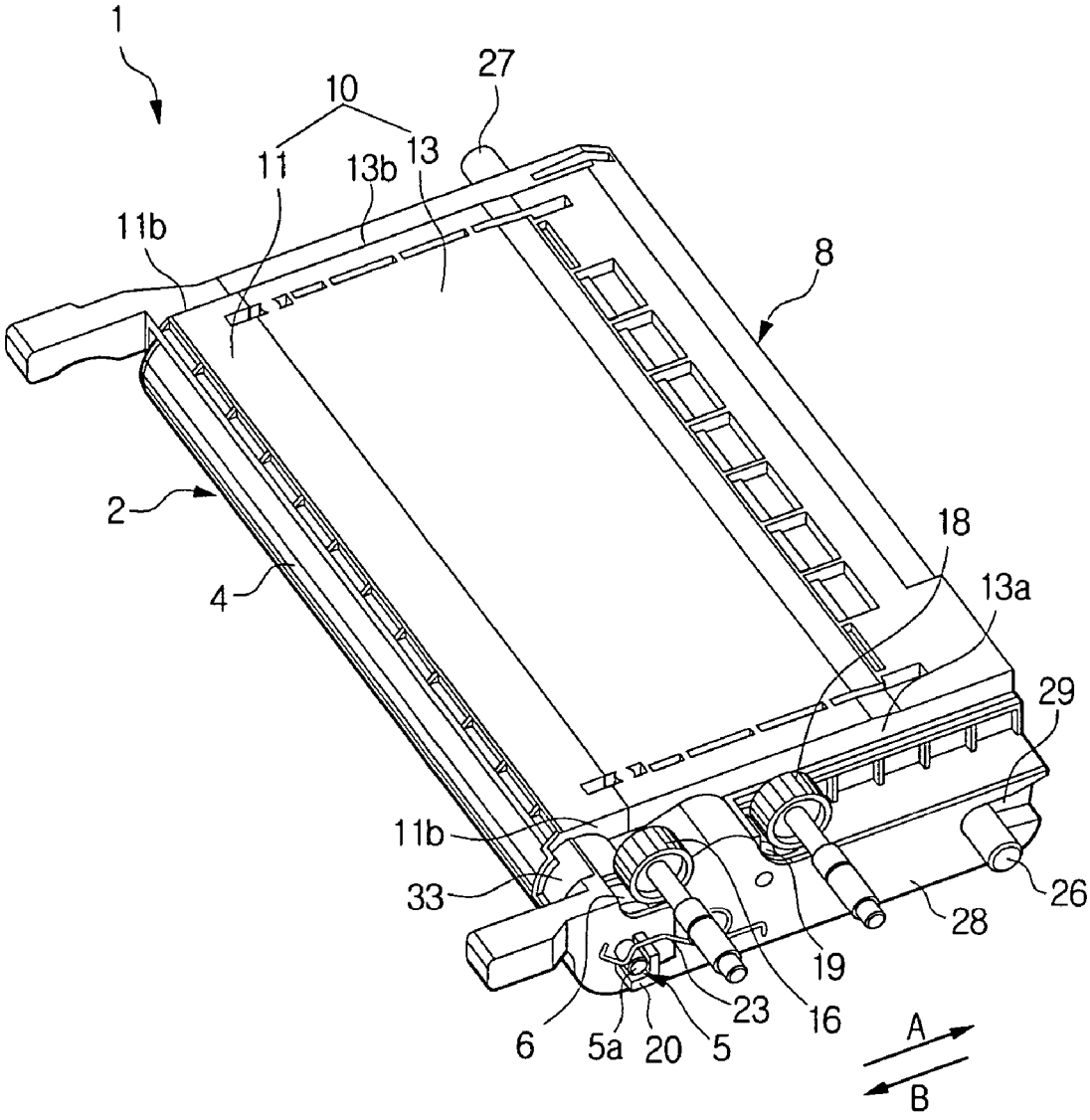
FIG. 2 (PRIOR ART)
Figure 3:
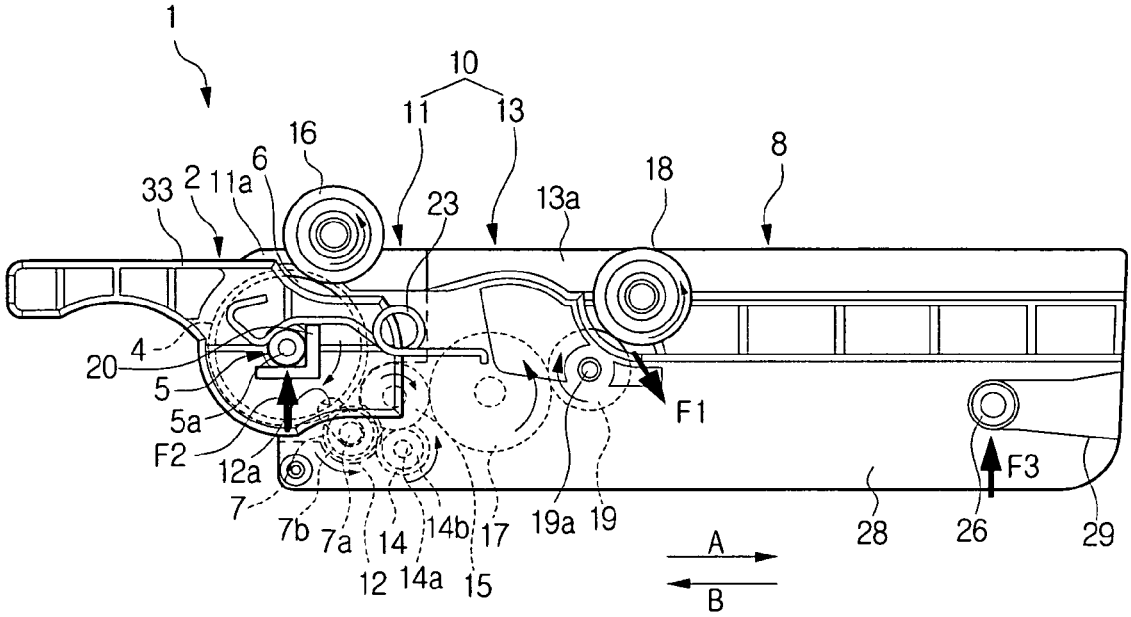
FIG. 3 (PRIOR ART)
FIG. 3 is a side elevational view in cross section of the process cartridge of FIG. 2.

Like the conventional process cartridge 1 described with reference to FIG. 1, the photoconductive medium casing 211 and the developing casing 213 are connected with each other by a slide groove 212*a* that is formed in a lower portion 212 of the first lateral frame 211*a* of the photoconductive medium casing 211 to receive a developing roller shaft 107*a*, and a fixing hole (not shown) of a fixing part that is formed in a rear portion (the left in the drawings) of the second lateral frame 213*b* of the developing casing 213 to receive and rotatably support a second end portion (not shown) of a photoconductive medium shaft 105.

The driving unit 215 drives the cartridge unit 110 and includes first, second, third, and fourth cartridge driving apparatuses 215Y, 215M, 215C, and 215K, which drive the first to the fourth process cartridges 110Y to 110K, respectively. Only the first cartridge driving apparatus 215Y is illustrated in the drawings.

Because the first to the fourth cartridge driving apparatuses 215Y to 215K have substantially the same construction, only the first cartridge driving apparatus 215Y for driving the first process cartridge 110Y is described for the sake of conciseness and brevity.

Figure 6:
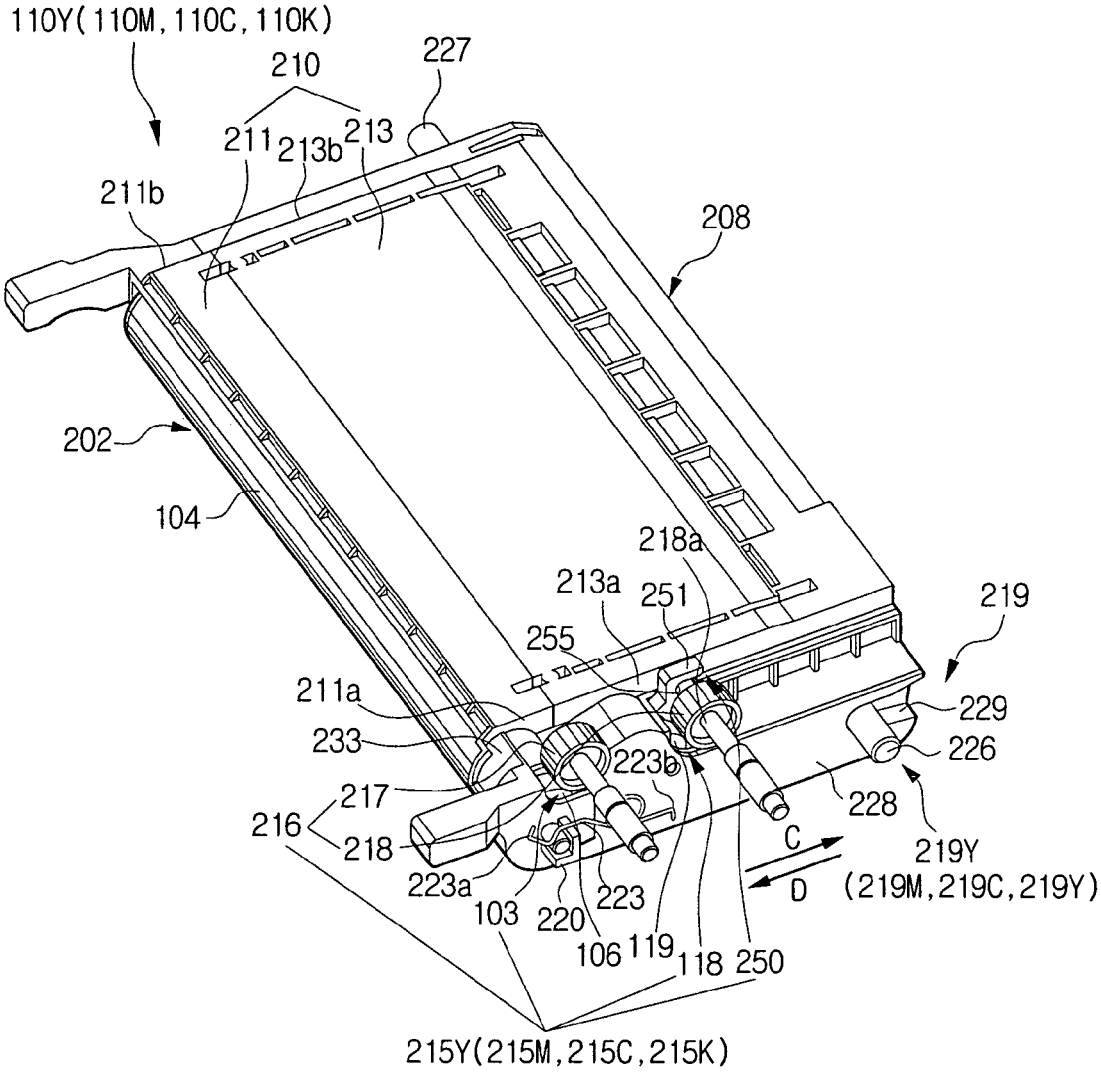

As shown in FIGS. 5 and 6, the first cartridge driving apparatus 215Y includes a body driving part 216, a photoconductive medium driving part 103 (see FIG. 6), a developing driving part 118, and a driving force coupling part 250.

The body driving part 216 includes first and second driving motors (not shown) disposed in a body 178, first and second gear trains (not shown) for receiving driving forces from the first and the second driving motors, and first and second driving gears 217 and 218 connected to the first and the second gear trans.

Although the first and the second driving gears 217 and 218 receive the driving forces from the first and second driving motors through the first and the second gear trains in this exemplary embodiment, they may receive a driving force from a single driving motor (not shown) through a single gear train (not shown) including a driving force conversion apparatus.

The photoconductive medium driving part 103 includes a first driven gear 106 disposed on a first end portion 105*a* of the photoconductive medium shaft 105, which protrudes outwardly from the first lateral frame 211*a* of the photoconductive medium casing 211 and is covered by the first lateral cover 233.

The first driven gear 106 is engaged with the first driving gear 217 of the first gear train receiving the driving force from the first driving motor of the body 178 when the first process cartridge 110Y is mounted in the cartridge frame 108 of the body 178.

Accordingly, the photoconductive medium 104 is rotated by the first driving gear 217 of the first gear train in one direction, for example, in a clockwise direction (see FIG. 8B). Because the first gear train is substantially identical to a well-known gear train, its detailed description is omitted.

As shown in FIGS. 8A and 8B, the developing driving part 118 includes the developing roller gear 107*b* disposed on one end portion of the developing roller shaft 107*a* that protrudes from the first lateral frame 213*a* of the developing casing 213 and is covered by the second lateral cover 228. The developing roller gear 107*b* is connected with the second driven gear 119 through the driving force transmission gear 115 and the deceleration gear 117. The driving force transmission gear 115 and the deceleration gear 117 each have a shaft, both ends of which are rotatably disposed between the first lateral frame 213*a* and the second lateral cover 228. A supplying roller gear 114*b*, which is coaxially disposed with the supplying roller 114, is engaged with the driving force transmission gear 115 engaged with the developing roller gear 107*b* in a lower position.

When the first process cartridge 110Y is mounted in the cartridge frame 108 of the body 178, as shown in FIG. 8B, the second driven gear 119 is engaged with the second driving gear 218 of the second gear train connected to the second driving motor mounted in the body 178.

Accordingly, when the second driving motor of the body 178 is driven after the first process cartridge 110Y is mounted in the cartridge frame 108, the second driven gear 119 is rotated by the second driving gear 218 in one direction, for example, in a clockwise direction. The clockwise rotational force of the second driven gear 119 is transmitted to the developing roller gear 107*a* and the supplying roller gear 114*a* through the deceleration gear 117 and the driving force transmission gear 115, and accordingly, the developing roller 107 and the supplying roller are rotated in a counterclockwise direction, respectively.

The driving force coupling part 250 couples the second driving gear 218 and the second driven gear 119 to not move with respect to each other when the first process cartridge 110Y is mounted in the cartridge frame 108. The driving force coupling part 250 includes an axle distance maintaining member 251 for maintaining a substantially constant distance between axes of the second driven gear 119 and the second driving gear 218.

Figure 7:
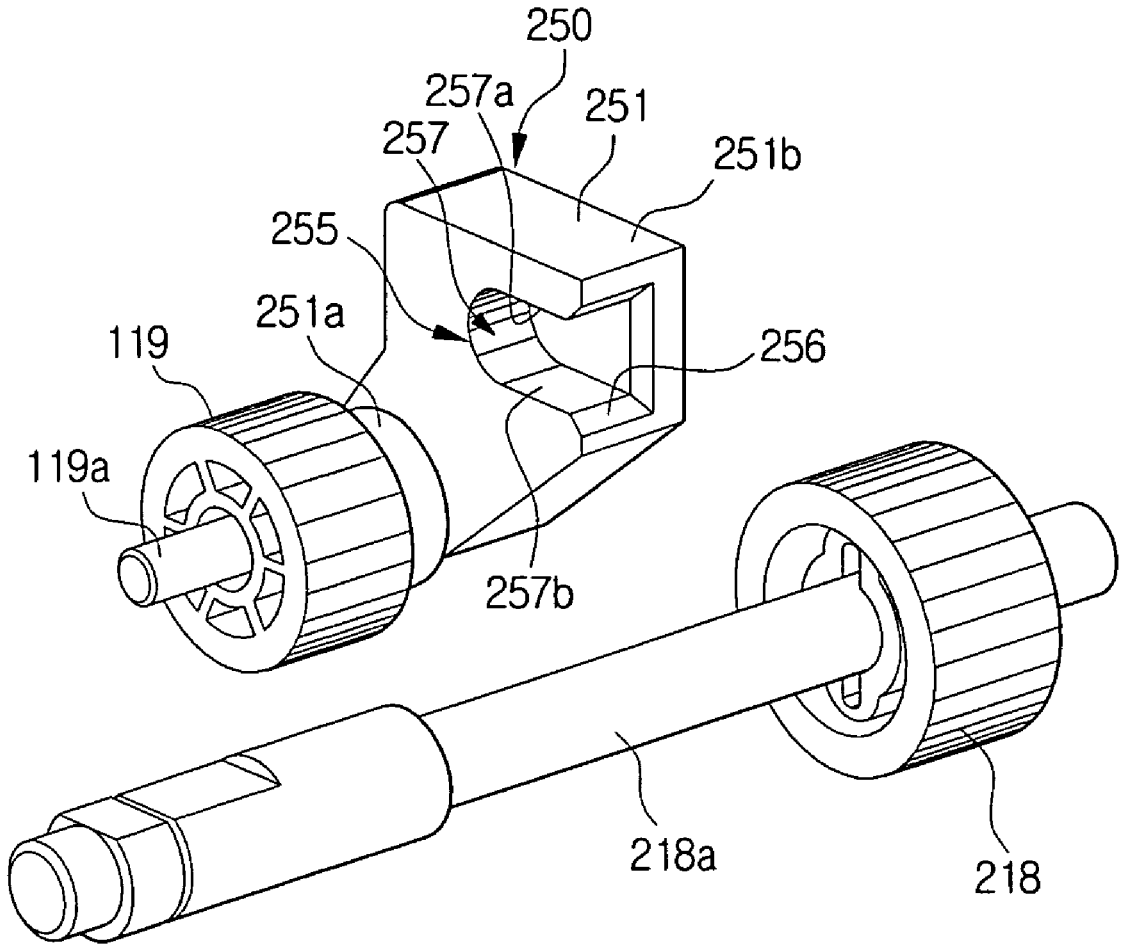
FIG. 7 is a perspective view of the driving force coupling part of the driving unit of the image forming device of FIG. 5.

As shown in FIG. 7, the axle distance maintaining member 251 has a shaft supporting bracket having one end 251*a* fixed to a second driven gear shaft 119*a*. The shaft supporting bracket in the other end 251*b* thereof has a shaft supporting part 255 formed to receive and support a second driving gear shaft 218*a* when the first process cartridge 110Y is mounted in the cartridge frame 108 of the body 178.

The shaft supporting part 255 is a shaft supporting recess and comprises an entrance 256 and a seating portion 257. The entrance 256 is open in the directions indicated by the arrows C and D (FIG. 6), such that the second driving gear shaft 218*a* is received in and removed from the entrance 256 when the first process cartridge 110Y is pushed in or pulled out to be mounted or dismounted in the directions of C or D. The seating portion 257 includes upper and lower shaft supporting surfaces 257*a* and 257*b* that are formed in a substantially perpendicular relation to a direction in which a driving torque of the second driving gear 218 and a load torque are exerted, thereby regulating a force 'F1" (FIG. 8B) generated by the load torque of the second driven gear 119 in response to the driving torque of the second driving gear 218 when a driving force is transmitted from the second driving gear 218 to the second driven gear 119.

The cartridge fixing unit 219 fixes the cartridge unit 110 to the cartridge frame 108 and has first, second, third, and fourth cartridge fixing parts 219Y, 219M, 219C and 219K to fix the first to the fourth process cartridges 110Y to 110K to the chest body 151 of the cartridge frame 108, respectively.

Because the first to the fourth cartridge fixing parts 219Y to 219K have substantially the same construction, only the first cartridge fixing part 149 for fixing the first process cartridge 219Y to the chest body 151 is described for the sake of conciseness and brevity.

The first cartridge fixing part 219Y includes first and second mounting protrusions 226 and 227, first and second mounting guide recesses 229 (only the first mounting guide recess 299 is illustrated), first and second protruding seating members 220 and 221, and first and second locking springs 223 and 224.

The first and second mounting protrusions 226 and 227, respectively, protrude from front portions (the right in the drawings) of inside surfaces of first and second sidewalls 151*b* (in FIGS. 4A and 4*b*, only the second sidewall 151*b* is illustrated) of the chest body 151.

The first and second mounting guide recesses 229 are formed in front portions of the second lateral cover 228 and the second lateral frame 213*b* of the developing casing 213 to correspond to the first and the second mounting protrusions 226 and 227 formed on the inside surfaces of the first and the second sidewalls 151*b*. The first and second mounting guide recesses 229 are open to the front of the second lateral cover 228 and the second lateral frame 213*b* such that the first and second mounting guide recesses 229 guide and receive the first and second mounting protrusions 226 and 227 formed on the body 178 or removes them when the first process cartridge 110Y is mounted in or dismounted from the chest body 151.

The first and second protrusion seating members 220 and 221, respectively, protrude from rear portions (the left in the drawings) of the inside surfaces of the first and the second sidewalls 151*b* of the chest body 151 to correspond to the first and second end portions 105*a* (only the first end portion 105*a* is illustrated in the drawings) of the photoconductive medium shaft 105 that protrude outwardly from the rear portions of the first and the second lateral frames 211*a* and 211*b* of the photoconductive medium casing 211. The first and second protruding seating members 220 and 221 are substantially L-shaped. The first and the second protruding seating members 220 and 221 receive and support the first and the second end portions 105*a* of the photoconductive medium shaft 105 when the first process cartridge 110Y is mounted in the chest body 151.

The first and second locking springs 223 and 224 are disposed on first and second shafts (not shown) disposed at rear portions (the left in the drawings) of the inside surfaces of the first and the second sidewalls 151*b* of the chest body 151 adjacent to the first and second protruding seating members 220 and 221. The first and second locking springs 223 and 224 include supporting end portions 223*a* and 224*a*, and fixing end portions 223*b* and 224*b*. The supporting end portions 223*a* and 224*a* are placed on the first and second protruding seating members 220 and 221 to elastically press the first and second end portions 105*a* of the photoconductive medium shaft 105 to maintain the first and second end portions 105*a* of the photoconductive medium shaft 105 in the first and second protruding seating members 220 and 221. The fixing end portions 223*b* and 224*b* are supported by a first and second spring supporting parts (not shown) formed on inside surfaces of the first and second sidewalls 151*b* for the first and second locking spring 223 and 224 to generate an elastic force.

Accordingly, when the first process cartridge 110Y is pushed in the direction indicated by the arrow 'C' from the position as shown in FIGS. 5A and 8A to be mounted in the chest body 151, the first and second end portions 105*a* of the photoconductive medium shaft 105 upwardly push the supporting end portions 223*a* and 224*a* of the first and the second locking springs 223 and 224 and are seated in the first and second protruding seating members 220 and 221 formed in the body 178, and then, are elastically locked into the first and second protruding seating members 220 and 221 by the first and second locking springs 223 and 224.

When the first process cartridge 110Y is pulled out in the direction of 'D' from the position as shown in FIGS. 6 and 8B to be dismounted from the chest body 151, the first and second mounting guide recesses 229 guide the first and the second mounting protrusions 226 and 227 to remove them. The first and second end portions 105*a* of the photoconductive medium shaft 105 upwardly push the supporting end portions 223*a* and 224*a* of the first and the second locking springs 223 and 224 against the elastic force of the first and the second locking springs 223 and 224, and thereby are removed from the first and second protruding seating members 220 and 221.

Referring back to FIGS. 4A and 4B, the transfer unit 168 transfers toner images formed on the photoconductive media 104 of the first to the fourth process cartridges 110Y to 110K to paper P, and is integrally formed with a body cover 190 to be opened and closed along with the body cover 190.

The transfer unit 168 includes a paper transfer belt (PTB) 170, and a transfer part 155. The PTB 170 is rotatably supported by a plurality of rollers 171 supported on a cover frame 169. The transfer part 105 includes first, second, third, and fourth transfer rollers 155Y, 155M, 155C and 155K that are arranged in the cover frame 169 and face the photoconductive media 104 of the first to the fourth process cartridges 110Y to 110K inside the PTB 170. The first to the fourth transfer rollers 155Y to 155K elastically press the photoconductive media 104 of the first to the fourth process cartridges 110Y to 110C with a predetermined pressure to provide pressure to the paper P. Also, the first to the fourth transfer rollers 155Y to 155K are supplied with a predetermined level of transfer voltage to transfer the toner images from the photoconductive media 104 of the first to the fourth process cartridges 110Y to 110K to the paper P.

The fusing unit 124 fuses the toner images onto the paper P and includes a heating roller 126 and a pressing roller 127. The heating roller 126 has a heater (not shown) disposed therein to fuse the toner images onto the paper P with high temperature heat. The pressing roller 127 is pressed against the heating roller 126 by an elastic pressing device (not shown) to provide pressure to the paper P.

The discharge unit 131 discharges the paper P where the toner images are fused to a discharge tray 141, and includes a discharge roller 133 and a backup roller 135.

Although the driving force coupling part 250 of each of the first to the fourth cartridge driving apparatus 215Y to 215K of the driving unit 215 is disposed between the second driving gear 218 and the second driven gear 119, this should not be considered as limiting. For example, the driving force coupling part 250 may be disposed between the first driving gear 217 and the first driven gear 106 with substantially the same construction and operating principle of coupling the first driving gear 217 and the first driven gear 106 not to move with respect to each other.

Although the above-described image forming device employing the process cartridge having the driving unit 215 having the driving force coupling part 250 is exemplified by the color image forming device 100 including the plurality of process cartridges 110Y, 110M, 110C and 110K each integrating the photoconductive medium unit 202 and the developing unit 208 having the developing roller 107 as a single modular unit, this should not be considered as limiting. For example, the present invention may be applied to a monochrome image forming device (not shown) including a single process cartridge that integrates a photoconductive medium unit having a photoconductive medium and a developing unit having a developing roller as a single modular unit; or a mono-chrome or color image forming device (not shown) including one or a plurality of process cartridges (not shown) that integrate only a photoconductive medium unit (not shown) disposed in a body and having a single photoconductive medium and a developing unit (not shown) having a developing roller contacting the photoconductive medium with a predetermined gap as a single modular unit.

Hereinbelow, operations of mounting and dismounting the cartridge unit 110 of the color image forming device 100 in and from the cartridge frame 108 of the body 178 for the purpose of repair or replacement according to an exemplary embodiment of the present invention is described in detail with reference to FIGS. 4 to 8B.

First, the first to the fourth process cartridges 110Y to 110K of the cartridge unit 110 are mounted in the chest body 151 of the cartridge flame 108.

More specifically, to mount the first to the fourth process cartridges 110Y to 110K, the body cover 190 is pivoted on a pivoting shaft 193 and opened in one direction, for example, in a counterclockwise direction.

The first cartridge 110Y is inserted into the chest body 151 through an opening opened by the body cover 190.

Next, as shown in FIGS. 5 and 8A, the process cartridge 110Y is pushed in the direction indicated by arrow 'C' after the first and second mounting guide recesses 229 are aligned with the first and the second mounting protrusions 226 and 227.

When the first and second mounting protrusions 226 and 227 are almost inserted in the first and the second mounting guide recesses 229, the first and second end portions 105*a* of the photoconductive medium shaft 105 are placed on the first and the second protruding seating members 220 and 221.

When the first process cartridge 110Y is pushed further in the direction indicated by the arrow 'C', the first and the second end portions 105*a* of the photoconductive medium shaft 105 upwardly push the supporting end portions 223*a* and 224*a* of the first and second locking springs 223 and 224, and thereby are inserted in the first and the second protruding seating member 220 and 221, and then, are elastically locked into the first and the second protruding seating member 220 and 221 by the supporting end portions 223*a* and 224*a* of the first and the second locking springs 223 and 224.

Also, the first and the second driving gears of the first and the second gear trans connected to the first and the second driving motors mounted in the body 178 are engaged with the first and the second driven gears 106 and 119, respectively, and the second driving gear shaft 119*a* is inserted and seated in the seating portion 257 through the entrance 256, which is a shaft supporting recess of the shaft supporting part 255 of the axle distance maintaining member 251. Thus, the operation of mounting the first process cartridge 110Y is completed.

The second, third, and fourth process cartridges 110M, 110C, and 110K are mounted in substantially the same way as the above-described operation of mounting the first process cartridge 110Y.

When the body cover 190 is pivoted on the pivoting shaft 193 in the other direction, for example, in a clockwise direction, and closed as shown in FIG. 4A after the first to the fourth process cartridges 110Y to 110K are completely mounted, the operations of mounting the first to the fourth process cartridges 110Y to 110K are completed.

After that, when the first and the second driving motors are driven to perform an image forming operation, the first and second driving gears 217 and 218, which correspond to the first to fourth process cartridges 110Y to 110K, rotate the first and the second driven gears 106 and 119 in one direction, for example, in a clockwise direction.

Thus, the photoconductive medium 104 coaxially disposed with the first driven gear 106 is rotated in a clockwise direction. Also, the developing roller gear 107*b* and the supplying roller gear 114*b*, which are connected with the second driven gear 119 through the deceleration gear 117 and the driving force transmission gear 115, are rotated in a counterclockwise direction, respectively, and accordingly, the developing roller 107 and the supplying roller are rotated in a counterclockwise direction, respectively.

At this time, although the second driven gear 119 is subjected to a force 'F1" generated according to the change in a load torque in response to a driving torque of the second driving gear 218, the force 'F1" exerted to the second driven gear 119 is not transmitted to the first lateral frame 213*a* of the developing casing 213 and is blocked off because the second driven gear shaft 119*a* is subjected to the restriction of the first driving gear shaft 218*a* through the shaft supporting part 255 of the axle distance maintaining member 251. Thus, the distance between the second driving gear shaft 218*a* and the second driven gear shaft 119*a*, that is, the position of the second driven gear shaft 119*a*, does not substantially change.

Also, the second driven gear 119, which is located in the middle portion of each of the first to the fourth process cartridges 110Y to 110K, is periodically subjected to a pressure by the driving torque of the second driving gear 218, but the force exerted to the second driven gear 119 is compensated for by the second driving gear shaft 119*a* subjected to the restriction of the first driving gear shaft 218*a* through the shaft supporting part 255 of the axle distance maintaining member 251. Thus, vibrations do not occur in the first lateral frame 213*a* of the developing casing 213 and warp deformation between the photoconductive medium casing 211 and the developing casing 213, which is caused by a repelling force 'F2" and 'F3" of the first and the second protruding seating members 220 and 221 and the first and the second mounting protrusion 226 and 227 by the pressure applied by the second driving gear 218, is substantially prevented.

Because the second driven gear shaft 119*a* does not substantially change in position and warp deformation does not occur between the photoconductive medium casing 211 and the developing casing 213, a gap between the photoconductive medium 104 and the developing roller 107 is substantially maintained as initially set by a gap ring (not shown). Accordingly, there is no defect, such as jitter, in images formed by the first to the fourth process cartridges 110Y to 110K.

As the photoconductive medium 104 and the developing roller 107 are rotated with a substantially constant gap therebetween as described above, electrostatic latent images formed on the photoconductive medium 104 by the LSU 109 are developed into satisfactory developer images by developer supplied from the developing roller 107 by the supplying roller 114, without causing image defects, such as jitter, due to the change in the gap between the developing roller 107 and the photoconductive medium 104.

Next, operation of dismounting the first, second, third, and fourth process cartridges 110Y, 110M, 110C, and 110K for the purpose of repair or replacement is described.

First, to dismount a process cartridge, for example, the first process cartridge 110Y, to repair or replace it, the body cover 190 is pivoted on the pivoting shaft 193 in one direction, for example, in a counterclockwise direction, and is opened as shown in FIG. 4.

Next, the first process cartridges 110Y is pulled out from the position as shown in FIGS. 6 and 8B in the direction indicated by the arrow 'D'.

As the first process cartridge 110Y is pulled out in the direction of 'D', the first and second end portions 105*a* of the photoconductive medium shaft 105 upwardly push the supporting end portion 223*a* and 224*a* against the elastic force of the first and second locking springs 223 and 224, and thereby are removed from the first and second protruding seating members 220 and 221.

The first and second driving gears 217 and 218 of the first and second gear trains connected with the first and second driving motors mounted in the body 178 are disengaged from the first and the second driven gears 106 and 119, and the second driving gear shaft 218*a* is removed from the seating portion 257 through the entrance 256 of the shaft supporting part 255 of the axle distance maintaining member 251.

After that, when the first and the second mounting protrusions 226 and 227 are completely removed from the first and second mounting guide recesses 229, the first process cartridge 110Y is drawn out through an opening opened by the body cover 190.

The drawn-out first process cartridge 110Y is dissembled if a repair is necessary, and it is replaced with a new one if replacement is necessary.

The repaired or replaced first process cartridge 110Y is inserted back to the chest body 151 through the opening opened by the body cover 190 to be mounted in the cartridge frame 108, and is mounted in the chest body 151 in substantially the same way as described above.

Next, when the body cover 190 is pivoted on the pivoting shaft 193 and closed in a clockwise direction, the operation of replacing the first process cartridge 1110Y is completed.

According to exemplary embodiments of the present invention as described above, the driving apparatus, and the process cartridge and the image forming device employing the same couple the first or second driving gear and the first or second driven gear not to move with respect to each other when a driving force is transmitted from the first or second driving gear of the body to the first or second driven gear of the process cartridge, thereby maintaining a substantially constant distance between axes of the first or second driving gear and the first or second driven gear. As a result, change in a position of the first or second driven gear shaft and a deformation of the process cartridge that are caused by a driving torque of the first or second driving gear and a load torque of the first or second driven gear are substantially prevented, and it is also possible to minimize the change in a gap between the developing roller and the photoconductive medium. Accordingly, no defect, such as jitter, occurs in an image formed by the process cartridge The foregoing embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A driving apparatus of an image forming device, comprising:

a driving gear connected to a driving motor;

a driven gear engaged with the driving gear; and a driving force coupling part coupling the driving gear and the driven gear upon mounting a process cartridge in the image forming device to substantially prevent non-rotational movement with respect to each other, wherein the driving gear and the driven gear are uncoupled prior to mounting the process cartridge in the image forming device.

2. The driving apparatus as claimed in claim 1, wherein the driving force coupling part includes an axle distance maintaining member to maintain a substantially constant distance between axes of the driving gear and the driven gear.

3. The driving apparatus as claimed in claim 2, wherein the axle distance maintaining member includes a shaft supporting bracket that has one end fixed to a driven gear shaft and the other end having a shaft supporting part receiving and supporting a driving gear shaft.

4. The driving apparatus as claimed in claim 3, wherein the shaft supporting part includes a shaft supporting recess.

5. The driving apparatus as claimed in claim 4, wherein an entrance in the shaft supporting recess is open to receive and remove the driving gear shaft therethrough.

6. The driving apparatus as claimed in claim 5, wherein a seating portion has a plurality of shaft supporting surfaces formed in a direction different to a direction in which a driving torque of the driving gear and a load torque of the driven gear generated in response to the driving torque are exerted, and that receives the driving gear shaft to restrict the driving gear.

7. The driving apparatus as claimed in claim 1, wherein the driving gear is disposed in a body of the image forming device and connected to the driving motor, and the driven gear is disposed in the process cartridge dismountably disposed in the body and is engaged with the driving gear to transmit a driving force to a developing roller when the process cartridge is mounted in the body.

8. A process cartridge of an image forming device, comprising:

at least one of a photoconductive unit having a photoconductive medium where an electrostatic latent image is formed and a developing unit having a developing roller to develop an electrostatic latent image of the photoconductive unit;

a driving apparatus unit including at least one of a first driven gear formed on a photoconductive medium shaft and a second driven gear transmitting a driving force to the developing roller; and a driving coupling part that couples at least one of the first and the second driven gears and at least one driving gear disposed on a body of the image forming device upon mounting a process cartridge in the image forming device to substantially prevent non-rotational movement with respect to each other, wherein the at least one of the first and second driven gears and the at least one driving gear are uncoupled prior to mounting the process cartridge in the image forming device; and a housing integrating at least one of the photoconductive medium unit and the developing unit, and the driving apparatus unit as a modular unit.

9. The process cartridge as claimed in claim 8, wherein the driving force coupling part includes an axle distance maintaining member to substantially uniformly maintain a distance between axes of at least one of the first and the second driven gears and the at least one driving gear.

10. The process cartridge as claimed in claim 9, wherein the axle distance maintaining member includes at least one shaft supporting bracket that has one end fixed to at least one of a first and a second driven gear shafts and the other end having a shaft supporting part receiving and supporting a driving gear shaft when the process cartridge is mounted in the body.

11. The process cartridge as claimed in claim 10, wherein the shaft supporting part includes a shaft supporting recess.

12. The process cartridge as claimed in claim 11, wherein an entrance in the shaft supporting recess is open in a direction of receiving and removing the driving gear shaft to receive and remove the driving gear shaft when the process cartridge is mounted in and dismounted from the body.

13. The process cartridge as claimed in claim 12, wherein a seating portion having a plurality of shaft supporting surfaces are formed in a direction different to a direction in which a driving torque of the driving gear and a load torque of at least one of the first and the second driven gears generated in response to the driving torque are exerted, and the seating portion receives the driving gear shaft to restrict the driving gear shaft.

14. An image forming device, comprising:

a body including at least one driving motor and at least one driving gear connected to the driving motor; and at least one process cartridge including at least one of a photoconductive medium unit having a photoconductive medium where an electrostatic latent image is formed and a developing unit having a developing roller to develop an electrostatic latent image of the photoconductive medium;

a driving apparatus unit including at least one of a first driven gear formed on a photoconductive medium shaft and a second driven gear transmitting a driving force to the developing roller; and a driving force coupling part that couples at least one of the first and the second driven gears and the at least one driving gear of the body upon mounting a process cartridge in the image forming device to substantially prevent non-rotational movement with respect to each other, wherein the at least one of the first and second driven gears and the at least one driving gear are uncoupled prior to mounting the process cartridge in the image forming device; and a housing that integrates at least one of the photoconductive medium unit and the developing unit, and the driving apparatus unit as a single modular unit.

15. The image forming device as claimed in claim 14, wherein the driving force coupling part includes an axle distance maintaining member to maintain a substantially constant distance between axes of at least one of the first and the second driven gears and the at least driving gear.

16. The image forming device as claimed in claim 15, wherein the axle distance maintaining member includes at least one shaft supporting bracket having one end fixed to at least one of a first and a second driven gear shafts and the other end having a shaft supporting part receiving and supporting a driving gear shaft when the process cartridge is mounted in the body.

17. The image forming apparatus as claimed in claim 16, wherein the shaft supporting part has a shaft supporting recess.

18. The image forming apparatus as claimed in claim 17, wherein an entrance of the shaft supporting recess is open in a direction of receiving and removing the driving gear shaft to receive and remove the driving gear shaft when the process cartridge is mounted in and dismounted from the body.

19. The image forming apparatus as claimed in claim 18, wherein a seating portion has a plurality of shaft supporting surfaces formed in a direction different to a direction in which a driving torque of the driving gear and a load torque of at least one of the first and the second driven gears generated in response to the driving torque are exerted, and the seating portion receives the driving gear shaft to restrict the driving gear shaft.

* * * * *